US005996140A

United States Patent [19]

Kitamura

[11] Patent Number: 5,996,140

[45] Date of Patent: Dec. 7, 1999

[54] DEVICE FOR WASHING HUMAN BODY

[75] Inventor: Teruo Kitamura, Hamamatsu, Japan

[73] Assignee: Aluvo Co., Ltd., Hamamtsu, Japan

[21] Appl. No.: 09/312,487

[22] Filed: May 17, 1999

Related U.S. Application Data

[62] Division of application No. 08/898,495, Jul. 22, 1997.

[30] Foreign Application Priority Data

Apr. 14, 1997 [JP] Japan ..... 9-113377
Jun. 16, 1997 [JP] Japan ..... 9-176461

[51] Int. Cl.[6] ..... A47K 3/22

[52] U.S. Cl. ..... 4/604; 4/601; 4/597; 4/612; 607/82

[58] Field of Search ..... 4/615, 567, 556, 4/601, 604, 541.3, 584, 568, 555, 611, 612, 596, 597, 525, 524; 607/81, 82, 83

[56] References Cited

U.S. PATENT DOCUMENTS 3,613,127 10/1971 Bond ..... 4/601
5,136,735 8/1992 Zimmerman ..... 4/601
5,233,706 8/1993 Maehr ..... 4/596

FOREIGN PATENT DOCUMENTS 6-23009 2/1994 Japan ..... 4/601
7-308355 11/1995 Japan .

*Primary Examiner*—Henry J. Recla
*Assistant Examiner*—Tuan Nguyen
*Attorney, Agent, or Firm*—Nikaido Marmelstein Murray & Oram LLP

[57] ABSTRACT

A device for washing a user sitting in or reclining on a wheelchair including an open-bottomed, double-walled housing defining a washing chamber therein and having a top wall opposite the open bottom, opposing side walls, a front wall and a rear opening opposite the front wall. A door is provided for opening and closing the rear opening and a plurality of nozzles are secured to an interior wall of the housing member for injecting warm water toward the user sitting in or reclining on the wheelchair positioned in said washing chamber. The head of the user is located outside the washing chamber.

13 Claims, 8 Drawing Sheets

DEVICE FOR WASHING HUMAN BODY

This is a divisional application of Ser. No. 08/898,495 filed Jul. 22, 1997, now allowed.

BACKGROUND OF THE INVENTION

This invention relates generally to a device for washing a body of a user sitting in or reclining on a wheelchair and, more specifically, to a body washer adapted to be set on a floor having a water discharging port, such as on a bath room floor, and to inject droplets of warm water through a plurality of shower nozzles for washing the body of the user.

JP-A-7-308355 discloses a body washer as shown in FIGS. 9–11. In FIGS. 9–11, designated generally as 1 is a housing made of a hard plastic material and adapted to accommodate a user (A), such as a patient, sitting in a wheelchair 11. The housing 1 is in the form of a box and has an entrance at a rear side (left side in FIGS. 9 and 10) thereof through which the user sitting in the wheelchair 11 can enter the housing 1. A door 10 is provided for opening and closing the entrance. The housing 1 has a top wall provided with a recess 3 at its rear end so that the head of the user protrudes from the housing 1 through the recess 3.

The housing 1 has a bottom plate 4 reinforced by a bottom frame 5 made from grid-like rectangular pipes. The bottom plate 4 is provided with a pair of longitudinally extending, depressed portions 4*a* for guiding the left and right wheels 12 of the wheelchair 11, respectively, so that the user is positioned in the center in the lateral direction of the housing 1. The housing 1 has left and right side walls 6 each having a double-walled structure. Thus, each of the side walls 6 is composed of an inner wall 6*a* and an outer wall 6*b* defining therebetween a space 6*c* in which an inverted U-shaped pipe 7 is secured. A plurality of branched pipes 8 extend from each of the U-shaped pipes 7 and are oriented toward the user positioned in the housing 1. Each branched pipe 8 is equipped with a nozzle 9 at its tip end.

Each of the U-shaped pipe 7 is connected to an output pipe of a boiler (not shown) through a pump. Designated as 13 is a head rest attached to the door 10 for supporting the head of the user (A) thereon. A pipe 14 laterally extends within the housing 1 for being gripped by the user (A). Designated as 15 is a shower nozzle used for washing the hair of the user (A). The shower nozzle 15 is connected to a flexible tube extending out of the housing 1. In use, the user (A) sitting in the wheelchair 11 is introduced through the entrance into the housing 1 and, then, the door 10 is closed. Then, the pump is operated so that warm water in the form of small droplets is injected through each of the nozzles 9 toward the user (A).

The above washer has been found to have the following defects. Since the bottom of the housing 1 is closed with the bottom plate 4, the weight and height of the washer are increased. Further, the structure is complicated so that the costs are increased. Since the bottom plate 4 is located at a level higher than the floor, it is necessary to use gang boards in order to displace the wheelchair 11 from the floor to the bottom plate 4.. Such gang boards hinder the movement of an assistant for the user. Since the U-shaped pipes 7 are supported on the bottom plate 4 and rigid branched pipes 8 are located within the side walls 6, it is necessary to disassemble the side walls 6 and the bottom plate 4 in order to connect the pipes or to perform piping maintenance works. Further, since the U-shaped pipes 7 are connected through a pump to the output pipe from the boiler, the temperature and the flow rate of the warm water discharged from the nozzles 9 are apt to change when the water pressure of the city water is varied.

SUMMARY OF THE INVENTION

It is, therefore, an object of the present invention to provide a washing device which is devoid of the above-described defects of the conventional washer.

There is provided in accordance with one aspect of the present invention a device for washing a user sitting in a wheelchair, comprising:

an open-bottomed housing member defining a washing chamber therein and having a top wall member opposite said open bottom, opposing side wall members, a front wall member and a rear opening opposite said front wall member, each of said side wall members and front wall member being double-walled and including inner and outer walls to define a piping space therebetween;

a U-shaped opening formed in a rear end of said top wall member such that the neck of said user sitting in said wheelchair can be located therein with a gap being defined between the neck and said U-shaped opening when said wheelchair is positioned in said washing chamber;

a door for opening and closing said rear opening; and a plurality of nozzles secured to an interior wall of said housing member for injecting warm water toward said user sitting in said wheelchair positioned in said washing chamber.

The present invention also provides a device for washing a user reclining on a wheelchair, comprising:

an open-bottomed housing member defining a washing chamber therein and having a top wall member opposite said open bottom, opposing side wall members, a front wall member and a rear opening opposite said front wall member, each of said side wall members and front wall member being double-walled and including inner and outer walls to define a piping space therebetween;

a plurality of nozzles secured to an interior wall of said housing member for injecting warm water toward said user reclining on said wheelchair positioned in said washing chamber;

a door for opening and closing said rear opening, said door having a rearwardly inflated portion such that the head of said user reclining on said wheelchair can be disposed therein with a gap being defined between the head and said inflated portion when said wheelchair is positioned in said washing chamber an d when said door is closed; and closure means for closing the upper space of said opening defined above said recessed portion when said door is closed, said closure means having a U-shaped opening into which the neck of said user reclining on said wheelchair can be fitted when said wheelchair is positioned in said washing chamber.

BRIEF DESCRIPTION OF THE DRAWINGS

Other objects, features and advantages of the present invention will become apparent from the detailed description of the preferred embodiments of the invention which follows, when considered in light of the accompanying drawings, in which.

DETAILED DESCRIPTION OF THE PREFERRED EMBODIMENTS OF THE INVENTION

Figure 1:
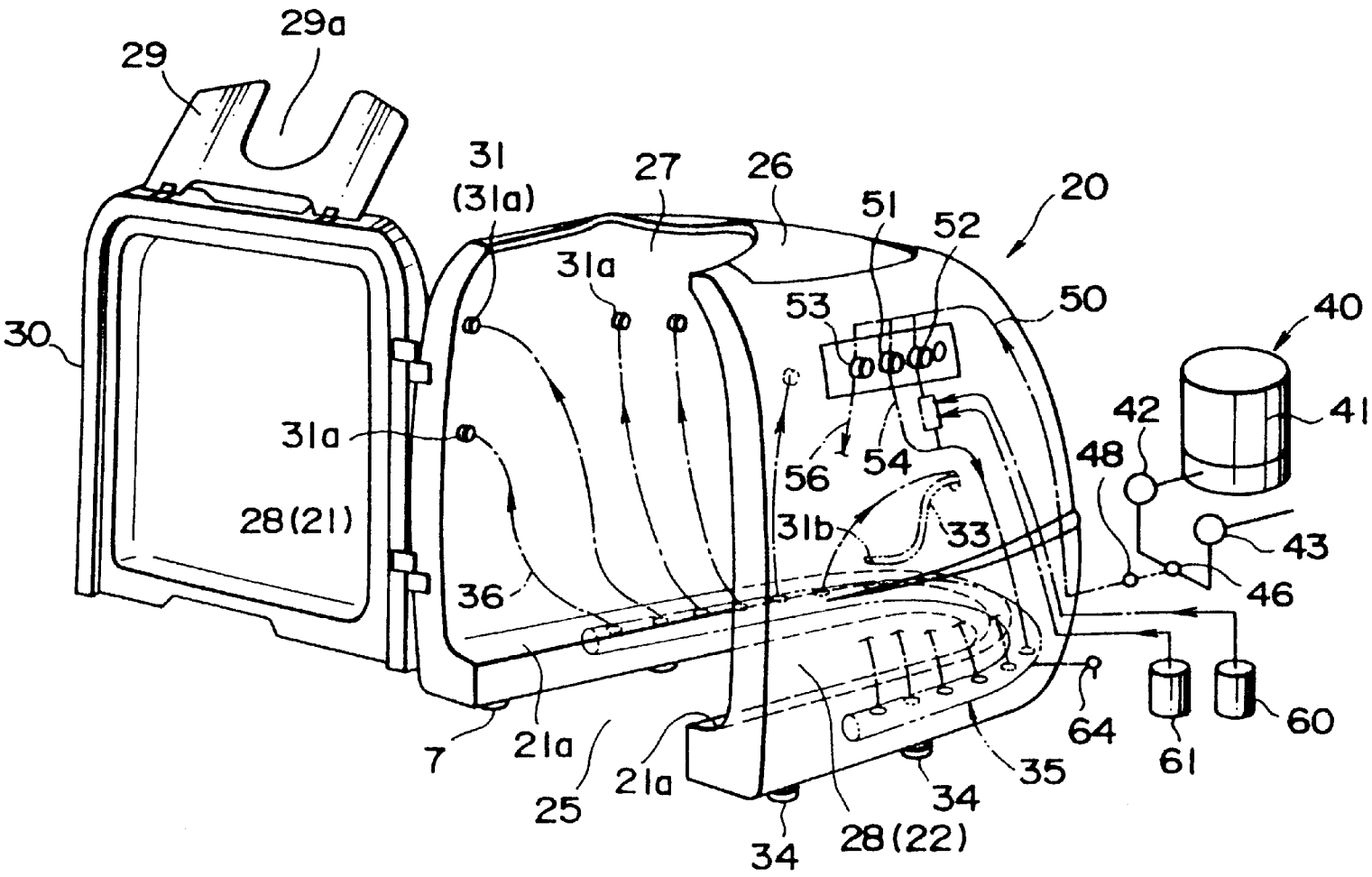
FIG. 1 is a perspective view diagrammatically showing a first embodiment of a body washer according to the present invention.

Referring now to FIGS. 1–4, the reference numeral 20 designates an open-bottomed housing member placed on a floor F. The housing member 20 is made of a fiber-reinforced plastic and defines therewithin a washing chamber for washing a user (A), such as a patient, sitting in a wheelchair 65. The housing member 20 has a top wall member 26 opposite the open bottom, opposing side wall members 28, a front wall member 28*a* and a rear opening 25 opposite the front wall member 28*a*. The rear opening 25 serves as an entrance for the user (A) sitting on the wheelchair 65.

Figure 2:
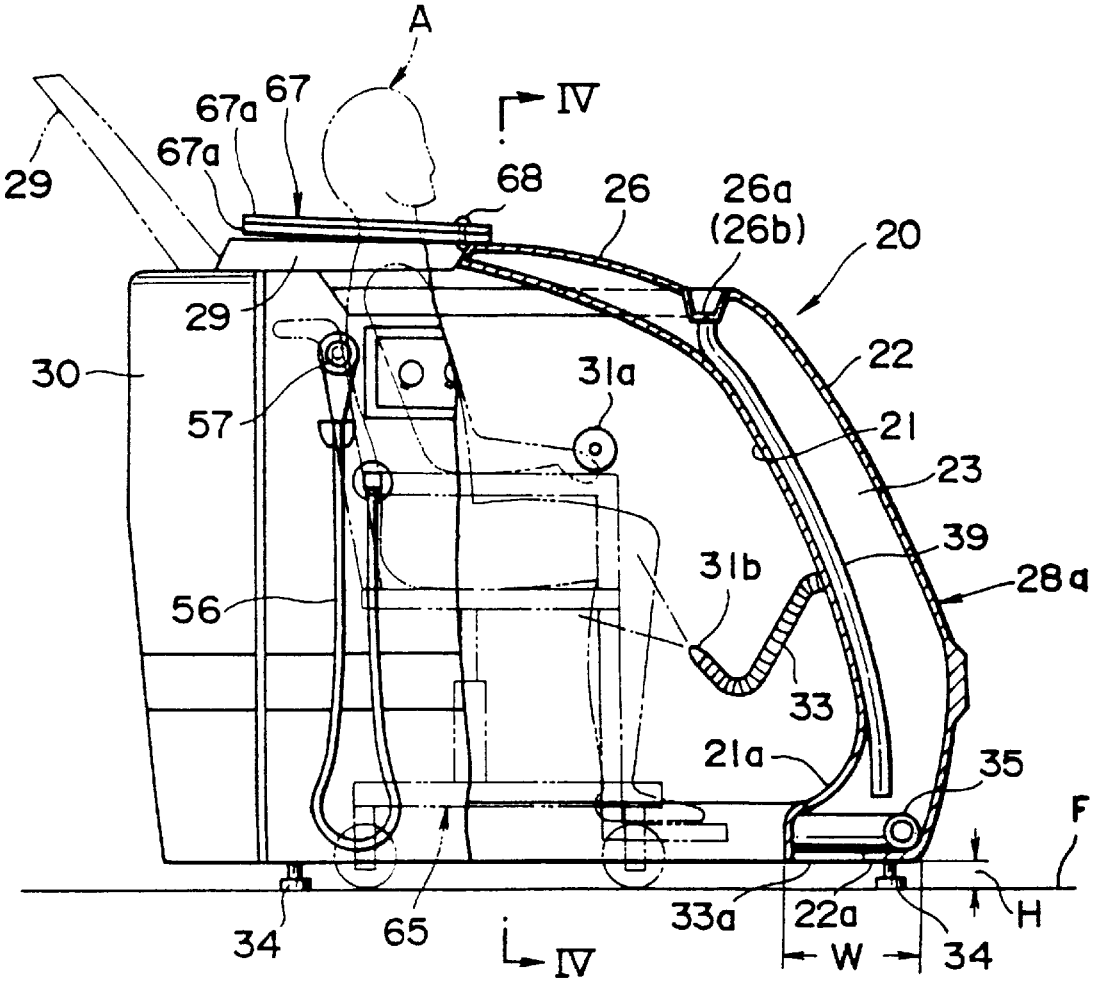
FIG. 2 is a cross-sectional, elevational, side view of the essential part of the body washer of FIG. 1.

The top wall member has a U-shaped opening 27 formed in a rear end thereof such that, as shown in FIG. 2, the neck of the user (A) sitting in the wheelchair 65 can be located therein with a gap being defined between the neck and the U-shaped opening 27 when the wheelchair 65 is positioned in the washing chamber.

Figure 3:
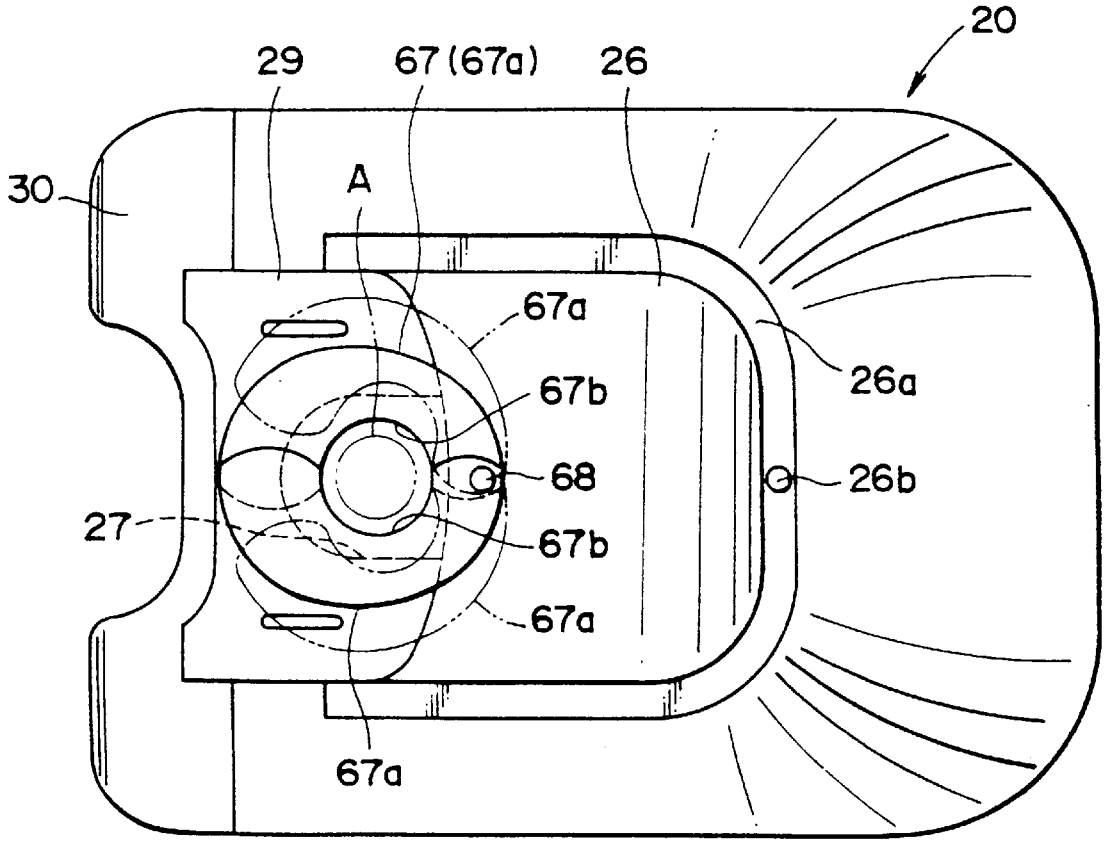
FIG. 3 is a plan view of FIG. 2.
Figure 4:
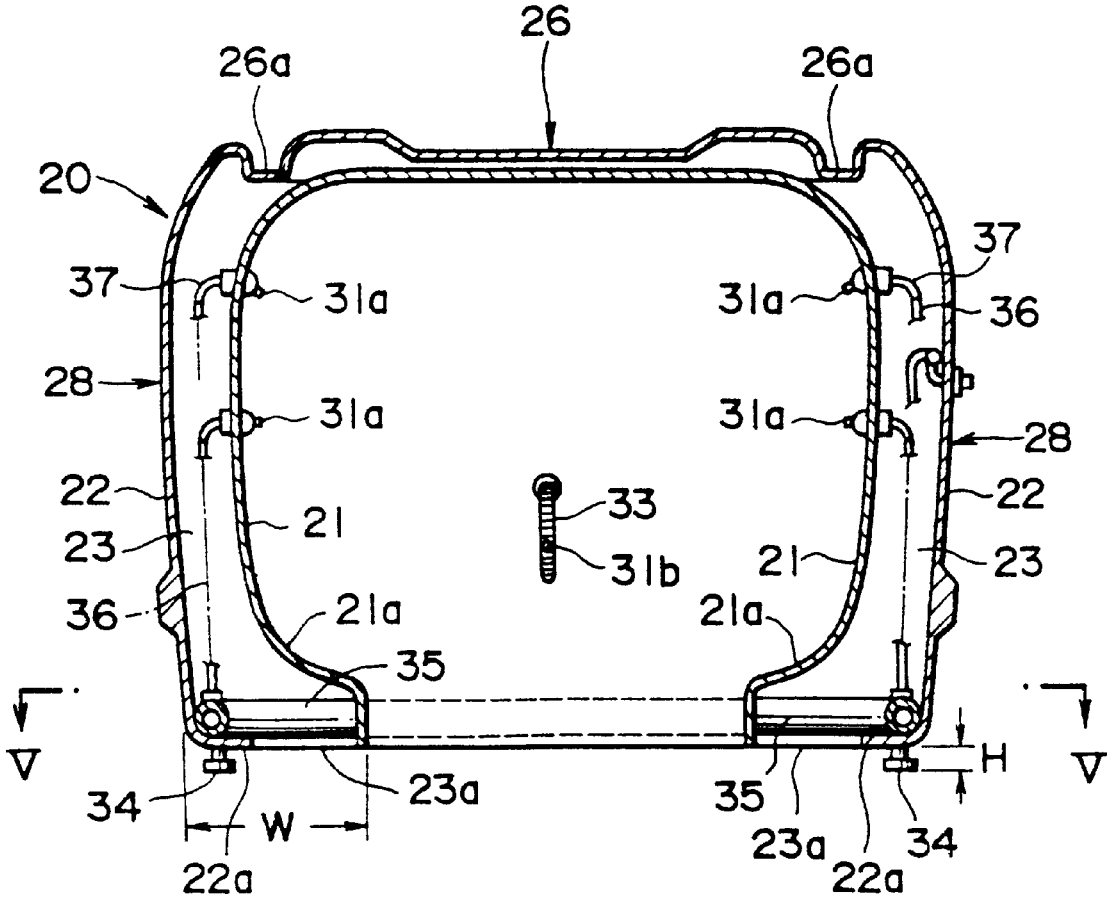
FIG. 4 is a sectional view taken on line IV—IV in FIG. 2.

A door 30 made of a fiber-reinforced plastic is provided for opening and closing the rear opening 25. A back cover 29 having a U-shaped recess 29*a* is hinged on a top of the door 30 and is rotatable between an open position as shown in FIG. 1 or as shown by the two-dotted line in FIG. 2 and a closed position as shown in FIG. 3 or by the solid line in FIG. 2. In the closed position, the back cover 29 partly closes the gap between the neck of the user (A) and the U-shaped opening 27.

In the illustrated embodiment, each of the top wall member 26, side wall members 28 and front wall member 28*a* is double-walled and includes an inner wall 21 and an outer wall 22 defining a piping space 23 therebetween. The piping space is open at its lower end 23*a*. The inner wall of each of the side wall members 28 and the front wall member 28*a* is inwardly bent or curved at a portion 21*a* adjacent lower end thereof and then directed vertically downward, so that the housing member 20 has an improved bending and torsional rigidity. Additionally, the falling washing water is directed inward upon impingement against the curved portion 21*a* so that splash of the falling water on the floor F is minimized.

The outer wall 22 of each of the side wall members 28 and front wall member 28*a* has a lower end inwardly bent to form a shelf board 22*a*, so that the housing member 20 has an improved bending and torsional rigidity. The shelf board 22*a* terminates at a position spaced apart from the inner wall 21 to form the opening 23*a* therebetween. A main tube 35 having an inside diameter of, for example, about 30 mm, made of, for example, a hard plastic such as polyvinyl chloride, and bent into a U-shape is disposed and supported on the shelf board 22*a* as best seen in FIG. 1. In assembling, the tube 35 is inserted through the opening 23*a* into the space 23 and placed on the shelf board 22*a* and is then secured thereon with suitable fixing means.

Figure 5:
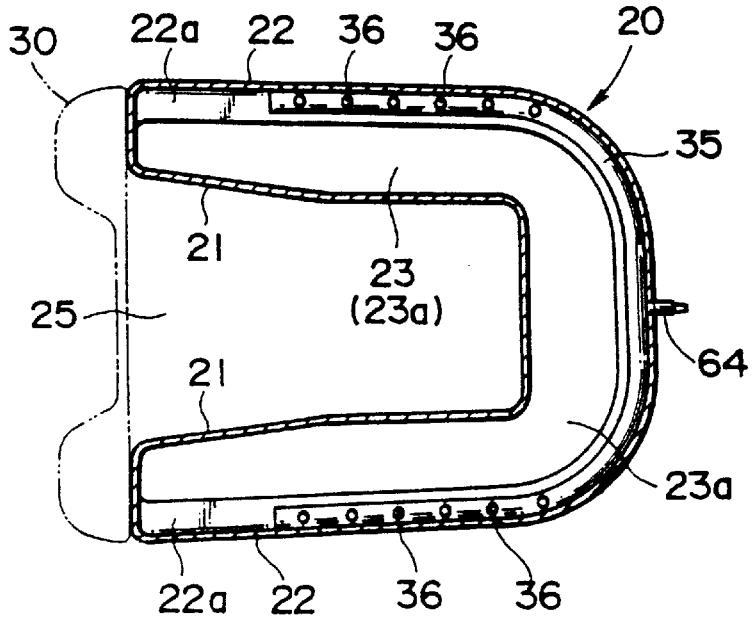
FIG. 5 is a sectional view taken on line V—V in FIG. 4.
Figure 6:
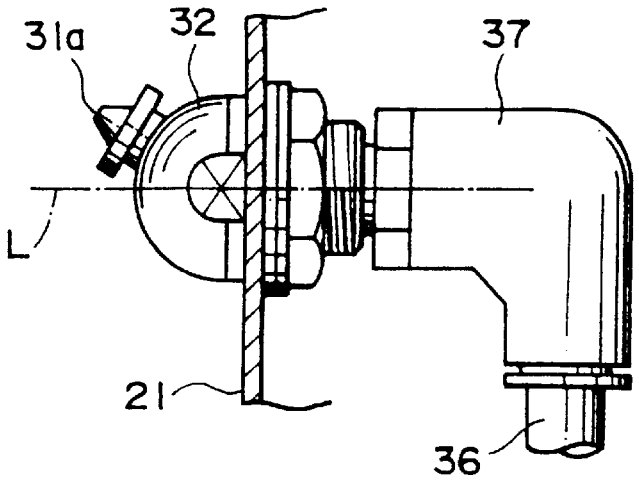
FIG. 6 is an enlarged cross-sectional view showing a nozzle attaching portion of the first embodiment.

A plurality of side nozzles 31*a* (five nozzles in the illustrated case) are secured to the inner wall 21 of each of the left and right side-wall members 28. Each of the nozzles 31*a* is connected to a flexible pipe 36 having an inside diameter of, for example, about 9 mm. Each of the flexible pipe 36 is disposed in the piping space 23 and branched from the main tube 35 as shown in FIG. 5. More particularly, as shown in FIG. 6, each of the side nozzles 31*a* is connected to a movable portion of a nozzle holder 32 having a base portion secured to the inner wall 21 of the side wall member 28. The moveable portion is secured to the base portion and rotatable about an axis L thereof. Each side nozzle 31*a* is oriented at an angle of about 30 degrees relative to the axis L of the corresponding nozzle holder 32. By rotation of the rotatable portion of the nozzle holder 32, the orientation of the side nozzle 31*a* relative to the user may be properly adjusted. Each of the rotatable portion of the nozzle holders 32 is shaped into a smooth hemispherical shape so as not to injure the body of the user. The base portion of each of the nozzle holders 32 is connected to an elbow 37 which in turn is connected to the flexible pipe 36.

As shown in FIG. 2, the inner wall 21 of the front wall member 28*a* is provided with a front nozzle 31*b*. The front nozzle 31*b* is connected at a tip end of a position-adjustable hose 33 extending from the inner wall 21. A flexible tube 36 extends between the hose 33 and the main tube 35. Thus, warm water supplied to the main tube 35 is injected as fine droplets from the side nozzles 31*a* and front nozzle 31*b* toward the user sitting in the wheelchair 65 accommodated in the housing member 20. The direction of the warm water injected from the side nozzles 31*a* can be adjusted by rotating the moveable portion of the corresponding nozzle holder 32 so that warm water can impinge upon desired portions of the body of the user (A). Also, the direction of the warm water injected from the front nozzle 31*b* can be adjusted by positioning the hose 33 in any desired orientation. Generally, the front nozzle 31*b* is used for washing the pubic and anal regions of the user (A).

Figure 7:
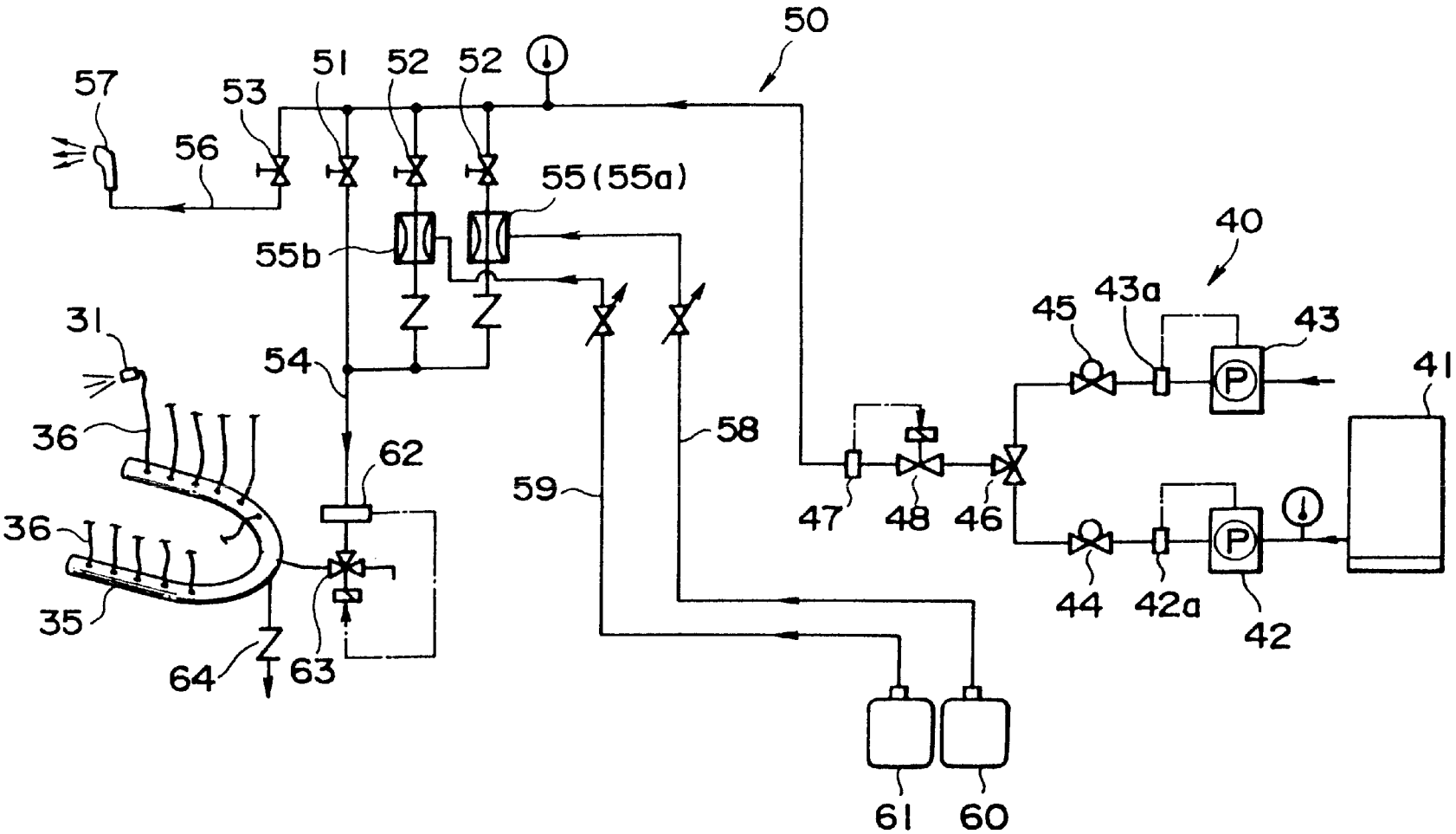
FIG. 7 is a diagram showing a pipe connection arrangement of the first embodiment.

The main tube 35 is connected to a warm water-supplying device 40. As shown in FIGS. 1 and 7, a first pump 43 is connected to a water source for increasing the pressure of water supplied thereto to, for example, 1.8–3.0 kg/cm$^2$, while a second pump 42 is connected to a hot water source (boiler) 41 for increasing the pressure of hot water supplied thereto to a predetermined pressure of, for example, in the range of 1.8–3.0 kg/cm$^2$. The pumps 42 and 43 are connected to pressure controlling valves 44 and 45, respectively, for controlling the pressure of the hot water fed from the second pump 42 and the pressure of the water fed from the first pump 43, respectively, to a predetermined pressure of, for example, in the range of 1.5–2.5 kg/cm$^2$. First and second flow switches 43*a* and 42*a* are interposed between the first pump 43 and the pressure controlling valve 45 and between the second pump 42 and the pressure controlling valve 44, respectively, and are operable to stop respective pumps 43 and 42 when the flow rate of the water and hot water passing therethrough exceeds a predetermined value.

Designated as 46 is a mixer connected to the pressure controlling valves 44 and 45 for mixing the water having a controlled pressure with the hot water having a controlled pressure in a suitable mixing ratio to obtain warm water having a predetermined temperature of, for example, about 43° C. The mixing ratio can be manually set as desired. The mixer 46 is connected to the main tube 35 through a feed pipe 50.

A high temperature sensor 47 and a shut off valve (solenoid valve) 48 are disposed in the feed pipe 50. The sensor 47 is adapted for detecting the temperature of the warm water discharged from the mixer 46. When the temperature of the warm water detected by the sensor 47 exceeds a predetermined maximum value, for example 45° C., the shut off valve 48 electrically coupled to the sensor 47 is operated for stopping the passage of the warm water therethrough.

Referring still to FIGS. 1 and 7, at an upper portion of the side wall member 28 of the housing member 20, there are disposed manual switching valves 51, 52 and 53 which are connected in parallel to the feed pipe 50. The valve 51 is connected to the main tube 35 through a flexible pipe 54. The valves 52 have outlet sides connected through mixers 55 of an ejector type to the flexible pipe 54. The mixers 55 have respective suction ports 55*a* and 55*b* connected to a sterilizing liquid tank 60 and a body shampoo tank 61 through suction hoses 58 and 59, respectively. When a selected one of the valves 52 is opened, the desired one of the sterilizing liquid and the shampoo is mixed with the warm water in the mixer 55 and the mixture is fed through the pipe 54 to the main tube 35. The valve 53 is connected to a hand shower 57 through a flexible housing extending out of the housing member 20 (see FIG. 1). The hand shower is suitably used for washing the hair of the user (A).

A low temperature sensor 62 and a switching valve 63 are disposed in the pipe 54. The sensor 62 is adapted for detecting the temperature of the warm water passing therethrough. When the temperature of the warm water detected by the sensor 62 is below a predetermined minimum value, for example 37° C., the valve 63 electrically coupled to the sensor 62 is operated for switching the passage of the warm water from the main tube 35 to a discharge side. When the detected temperature is not lower than the minimum value, the switching valve 63 directs the warm water toward the main tube 35.

An automatic discharging valve 64 of a spring-biased type is connected to the main tube 35 to release the warm water therefrom when the pressure therewithin is below a predetermined pressure. The automatic discharging valve 64 is closed by the pressure generated in the main tube 35 when the switching valve 63 is so shifted as to feed the warm water from the flexible pipe 54 to the main tube 35, thereby permit the warm water to be injected through the nozzles 31*a* and 31*b*. When the pressure within the main tube is lowered to atmospheric pressure due to the close of the manual switching valve 51 or the shifting of the switching valve 63 to the discharge side, the automatic discharging valve 64 opens so that the warm water within the main tube 35 and the flexible pipes 36 is discharged therefrom through a drain pipe connected to a lower side of the main tube 35, since the nozzles 31*a* and 31*b* are in fluid communication with the atmosphere. Thus, since the retaining of the water in the main tube 35 and the flexible pipes 36 is prevented during the non-operating stage, the liquid initially injected from the nozzles 31*a* and 31*b* is not the water cooled during the retaining in the main tube 35 but is warm water freshly supplied through the feed pipes 50 and 54.

Referring again to FIG. 2, height-adjustable legs 34 are attached to the underside of the shelf board 22*a* for adjusting the gap H between the bottom of the housing member 20 and the floor F to a desired distance. The gap H is so adjusted as to minimize the escape of water vapor from the housing member 20 but to maximize the condensation of water vapor during the passage through the gap H. The optimum gap H depends upon the distance W between the outer and inner walls 21 and 22. Generally, the gap H is in the range of 3–5 cm and the distance W is in the range of 15–20 cm. The height-adjustable legs 34 also serve to support the housing member 20 on the floor F in a stable position.

As shown in FIGS. 2 and 3, the outer wall 22 of the top wall member 26 is provided with a groove 26*a* extending along an outer periphery of the outer wall 22 such that the U-shaped opening 27 is surrounded by the groove 26*a*. The groove 26*a* is sloped down in the direction from the rear side to the front side and is provided with an opening 26*b* in the middle portion of the front side. The opening is connected to an upper end of a discharging hose 39. The discharging hose 39 extends through the piping space 23 and terminates at the lower end thereof at a position adjacent a lower end of the piping space 23. Thus, the washing water, such as used for washing the hair of the user (A) using the hand shower 57, falling on the top wall member 26 is collected in the groove 26*a* and is discharged on the floor F through the discharging hose 39.

Referring still to FIGS. 2 and 3, a pair of semicircular plate members 67*a* and 67*a* are pivotally supported by a pin 68 on the top wall member 26 such that rotation of the plate members can open and close the U-shaped opening 27. The plate members 67*a* and 67*a* are made of a soft plastic material and constitute a neck cover 67. Each of the plate members 67*a* and 67*a* has a depressed portion 67*b* so that the gap between the neck of the user (A) and the U-shaped opening 27 is closed with the plate members 67*a* and 67*a* with the neck of the user (A) being fitted into an opening defined by the depressed portions 67*b* and 67*b* when the plate members 67*a* and 67*a* are in the closed position. Thus, the water vapor within the housing member 20 is prevented from escaping therefrom through the gap between the neck of the user (A) and the U-shaped opening 27.

Figure 8:
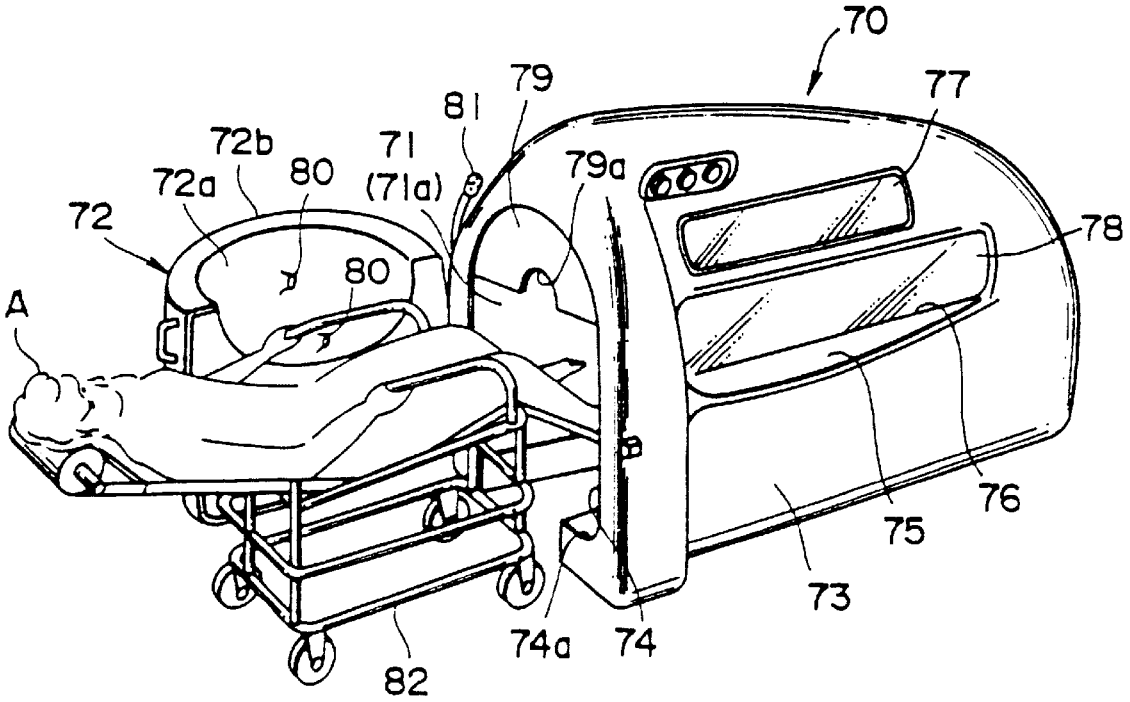
FIG. 8 is perspective view diagrammatically showing a second embodiment of a body washer according to the present invention.
Figure 9:
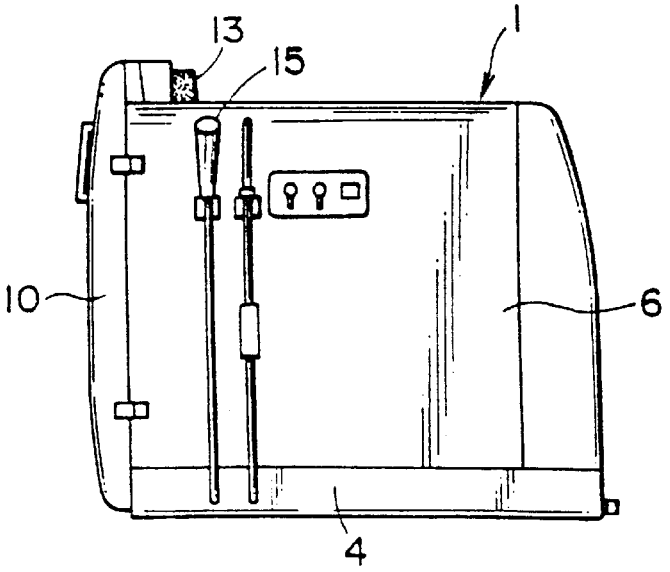
FIG. 9 PRIOR ART
FIG. 9 is a side view of a conventional body washer.
Figure 10:
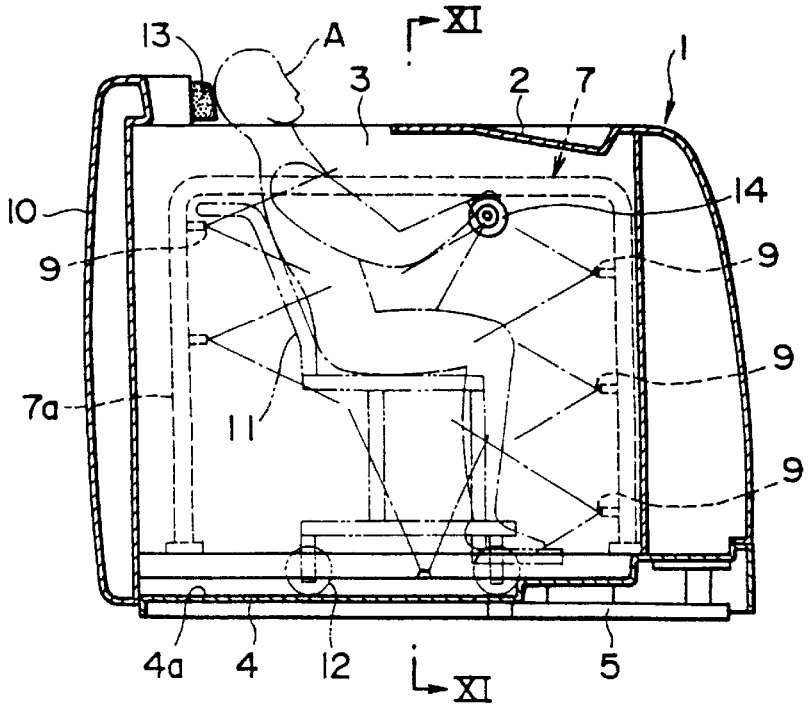
FIG. 10 PRIOR ART
FIG. 10 is an enlarged, cross-sectional, side view of the body washer of FIG. 9.
Figure 11:
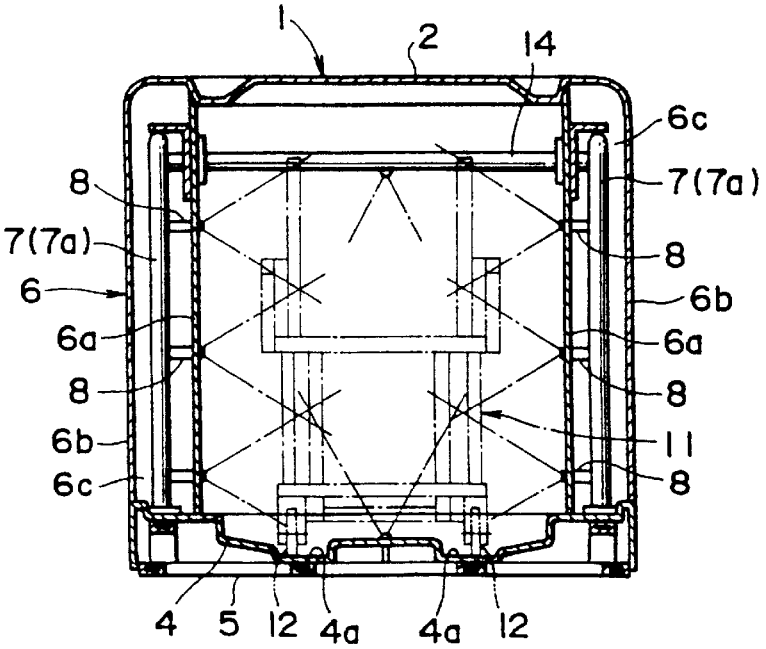
FIG. 11 PRIOR ART
FIG. 11 is a sectional view taken on line XI—XI in FIG. 10.

FIG. 8 depicts a second embodiment of the present invention. Since the construction of the housing member and the warm water supplying system of the second embodiment are substantially the same as those in the first embodiment, the detailed description thereof will be omitted here. Thus, the following description will be made mainly on features of the second embodiment different from those of the first embodiment.

The reference numeral 70 designates an open-bottomed housing member placed on a floor. The housing member 20 is made of a fiber-reinforced plastic and defines therewithin a washing chamber for washing a user (A), such as a patient, reclining on a wheelchair 82. The housing member 70 has an elongated box-like form which is open at the bottom and a rear end. The rear opening 71 serves as an entrance for the user (A) reclining on the wheelchair 82.

In the second embodiment, too, each of side wall members 73 and front wall member is double-walled to define a piping space therebetween. The piping space is open at its lower end 23*a*. The inner wall 74 of each of the side wall members 73 and the front wall member is inwardly bent or curved at a portion 74*a* adjacent lower end thereof and then directed vertically downward, so that the housing member 70 has an improved bending and torsional rigidity. Additionally, the falling washing water is directed inward upon impingement against the curved portion 74*a* so that splash of the falling water on the floor is minimized.

A plurality of side nozzles (for example, five nozzles) are secured to the inner wall 74 of each of the left and right side-wall members 73 similar to the first embodiment.

A door 72 made of a fiber-reinforced plastic is provided for opening and closing the rear opening 71. The door 72 has an upper end 72*b* at a level lower than the upper end of the rear opening 71 so that, when the door 71 is closed, there is formed a space 71*a* between the door 71 and the rear end of the housing member 70. The door has a rearwardly inflated portion to form a basin 72*a* in an upper part of the door 72 such that the head of the user (A) reclining on the wheelchair 82 can be disposed in the basin 72*a* with a gap being defined therebetween, when the wheelchair 82 is positioned in the washing chamber of the housing member 70 and when the door 72 is closed.

A closure member such as a neck curtain 79 of a soft sheet material is provided for closing the space 71*a* of the opening 71 defined above the basin 72*a* when the door is closed. The neck curtain has a U-shaped opening 79*a* into which the neck of the user (A) reclining on the wheelchair 82 can be fitted when the wheelchair 82 is positioned in the washing chamber of the housing member 70, so that water vapor in the washing chamber is prevented from escaping therefrom through the space 71*a*. One or more (two in the illustrated case) nozzles 80 are provided on the interior wall of the basin 72*a* for washing the neck and back of the user (A).

The inner wall 74 of each of the left and right side wall members 73 is provided with a stepped portion 75 for receiving the corresponding elbow of the user (A). At least one of the side wall members 73 is provided with a longitudinally extending opening 76 for insertion of a hand of an assisting person and a window 77 above the opening 76 to permit the assisting person to see the user (A) therethrough. The opening 76 may be closed by a closure means such as a curtain 78. The assisting person can wash, with a hand inserted through the opening 76, desired portions of the user (A). Designated as 81 is a hand a shower nozzle connected to a tip end of a flexible hose extending out of the housing member 70 for washing the head of the user (A).

What is claimed is:

1. A device for washing a user reclining on a wheelchair, comprising:

an open-bottomed housing member defining a washing chamber therein and having a top wall member opposite said open bottom, opposing side wall members, a front wall member and a rear opening opposite said front wall member, each of said side wall members and front wall member being double-walled and including inner and outer walls to define a piping space therebetween;

a plurality of nozzles secured to an interior wall of said housing member for injecting warm water toward said user reclining on said wheelchair positioned in said washing chamber;

a door for opening and closing said rear opening, said door having a rearwardly inflated portion such that the head of said user reclining on said wheelchair can be disposed therein with a gap being defined between the head and said inflated portion when said wheelchair is positioned in said washing chamber and when said door is closed; and closure means for closing the upper space of said opening defined above said inflated portion when said door is closed, said closure means having a U-shaped opening into which the neck of said user reclining on said wheelchair can be fitted when said wheelchair is positioned in said washing chamber.

2. A device as claimed in claim 1, wherein the inner wall of each of said side wall members is provided with a stepped portion for receiving the corresponding elbow of said user.

3. A device as claimed in claim 1, wherein each of said side wall members is provided with an opening for insertion of a hand of an assisting person and a window to permit said assisting person to see said user therethrough.

4. A device as claimed in claim 1, further comprising one or more nozzle provided in the interior wall of said inflated portion for injecting warm water toward the back of the user reclining on said wheelchair placed in said housing member.

5. A device as claimed in claim 1, wherein said piping space is open at a lower end thereof.

6. A device as claimed in claim 1, wherein said inner wall of each of said side wall members and said front wall member is inwardly bent at a lower end thereof.

7. A device as claimed in claim 1, wherein said outer wall of each of said side wall members and front wall member has a lower end inwardly bent to form a shelf board, and wherein each of said plurality of nozzles is connected to a flexible pipe disposed in said piping space and branched from a main tube disposed and supported on said shelf board.

8. A device as claimed in claim 7, further comprising an automatic discharging valve connected to said main tube and adapted to automatically operate to release the warm water from said main tube when the pressure within said main tube is a predetermined pressure.

9. A device as claimed in claim 1, further comprising height-adjustable leg means for supporting said housing member in a stable position.

10. A device as claimed in claim 1, further comprising first pump means to be connected to a water source for increasing the pressure of water supplied thereto, first controlling means connected to said first pump means for controlling the pressure of the water fed from said first pump means, second pump means to be connected to a hot water source for increasing the pressure of hot water supplied thereto, second controlling means connected to said second pump means for controlling the pressure of the hot water fed from said second pump means, a mixer connected to said first and second controlling means for mixing the water having a controlled pressure with the hot water having a controlled pressure to obtain warm water having a predetermined temperature, and pipe means for feeding the warm water having the predetermined temperature to said plurality of nozzles.

11. A device as claimed in claim 10, further comprising a high temperature sensor connected to said pipe means for detecting the temperature of the warm water, and a shut off valve disposed in said pipe means and coupled to said high temperature sensor for stopping the passage of the warm water therethrough when the temperature detected by said high temperature sensor exceeds a predetermined temperature.

12. A device as claimed in claim 11, further comprising a low temperature sensor connected to said pipe means at a position downstream of said high temperature sensor for detecting the temperature of the warm water, and a switching valve disposed in said pipe means and coupled to said low temperature sensor for directing the passage of the warm water to said plurality of nozzles when the temperature detected by said low temperature sensor is not lower than a predetermined temperature and to a discharge side when the temperature detected by said low temperature sensor is below said predetermined temperature.

13. A device as claimed in claim 1, further comprising a shower nozzle at a tip end of a flexible hose extending out of said housing member for washing the head of said user.

* * * * *